United States Patent [19]

Block

[11] 4,071,920

[45] Feb. 7, 1978

[54] SWEEPER

[75] Inventor: Thomas S. Block, Muskegon, Mich.

[73] Assignee: Clarke-Gravely Corporation, Muskegon, Mich.

[21] Appl. No.: 655,060

[22] Filed: Feb. 4, 1976

[51] Int. Cl.[2] ..... A47L 11/22; E01H 1/04

[52] U.S. Cl. ..... 15/49 C; 15/79 R; 280/47.37 R

[58] Field of Search ..... 15/79 R, 79 A, 83, 143–145, 15/49 C, 50 C; 280/47.34, 47.36, 47.37; 16/111 A

[56] References Cited

U.S. PATENT DOCUMENTS

| | | | |
|---|---|---|---|
| 434,233 | 8/1890 | Bailey | 15/79 R |
| 2,689,367 | 9/1954 | Parker | 15/79 R X |
| 2,834,034 | 5/1958 | Angell | 15/79 A |
| 3,048,868 | 8/1962 | Clark | 15/79 R |
| 3,462,924 | 8/1969 | Price et al. | 16/111 A |
| 3,649,997 | 8/1969 | Thorud | 16/111 A |
| 3,694,855 | 10/1972 | Meyer et al. | 280/47.37 X |

*Primary Examiner*—Edward L. Roberts

*Attorney, Agent, or Firm*—Price, Heneveld, Huizenga & Cooper

[57] ABSTRACT

The specification discloses a sweeper in which a combined tubular frame and handle member comprising a generally U-shaped forward frame portion which is continuous with an upwardly and rearwardly extending handle portion serves as the focal point of the sweeper design. The combined tubular frame and handle member is mounted on a brush housing, serves to facilitate support of a dust bin, and serves as the focal point for additional design features such as a body cradling upper handle portion, a hand hold at the front of the dust bin and a pivotal side brush mount.

17 Claims, 15 Drawing Figures

SWEEPER

BACKGROUND OF THE INVENTION

The present invention relates to sweepers, particularly of the industrial push sweeper type for cleaning shop areas, sidewalks and the like. It could also be used in self-propelled sweepers, but is particularly well suited to the lower priced push sweepers.

Typically, industrial push sweepers comprise a brush housing carrying a cylindrical brush and carrying wheels which rotate the brush. To this brush housing a handle is mounted for pushing the sweeper. The brush housing also serves to support a removable dust bin. Sometimes a frame element is also tacked onto the brush housing. It serves to further support the dust bin and typically a front wheel.

It is believed that such devices have not been as popular as they could be because, while inexpensive, they either do not offer sufficient value for their price or do not offer sufficient profitability to the manufacturer to really sell them. Attempts to build in value with added features typically require substantial added manufacturing costs. Sometimes such attempts require that additional devices be tacked onto the brush housing, as is the case, for example, in the sweeper shown in U.S. Pat. No. 3,101,498 to Davlantes, entitled "Sweeper" and issued Aug. 27, 1973, where a dust pan emptying pivoting device is additionally mounted on the brush housing.

SUMMARY OF THE INVENTION

In the present invention, the common prior art practice of making the brush housing the focal point of the design and the basis for tacking on additional items is rejected. Instead, the present invention utilizes a single, generally continuous combined tubular frame and tubular handle member which serves as the focal point of the design. The tubular, generally continuous combined frame and handle has a generally U-shaped forward frame portion which is generally continuous with a rearwardly and upwardly projecting handle portion. The dust bin is supported at least in part on the forward frame portion. This entire tubular member is mounted on the brush housing and this tubular member, rather than the brush housing, serves as the focal point for designing into the system additional features.

DETAILED DESCRIPTION OF THE PREFERRED EMBODIMENT

Figure 1:
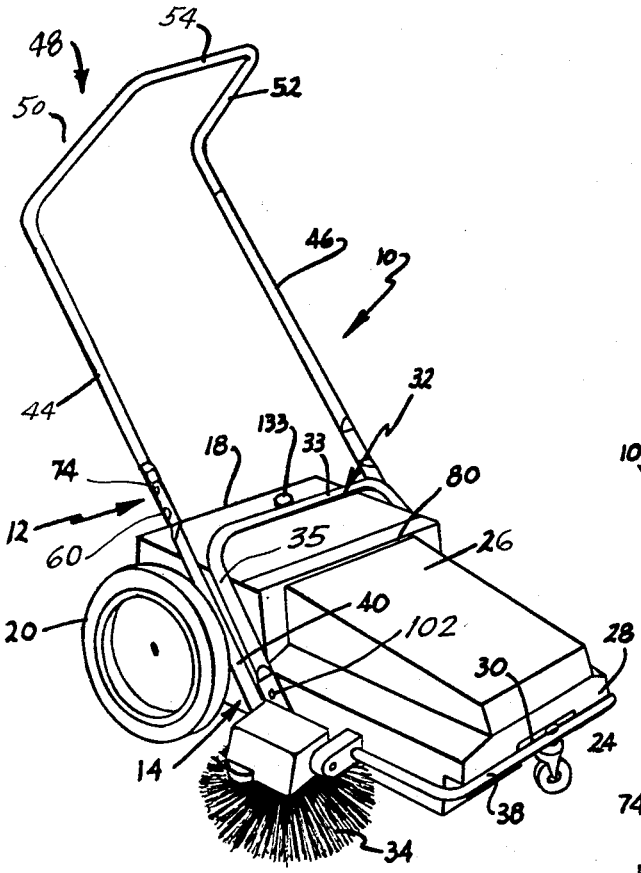
FIG. 1 is a perspective view of the push sweeper in accordance with the present invention.
Figure 2:
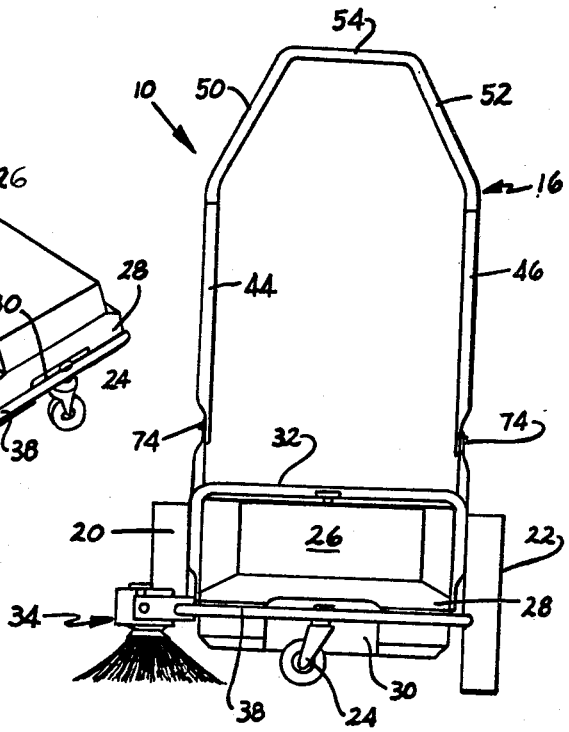
FIG. 2 is a front elevational view of the sweeper.
Figure 3:
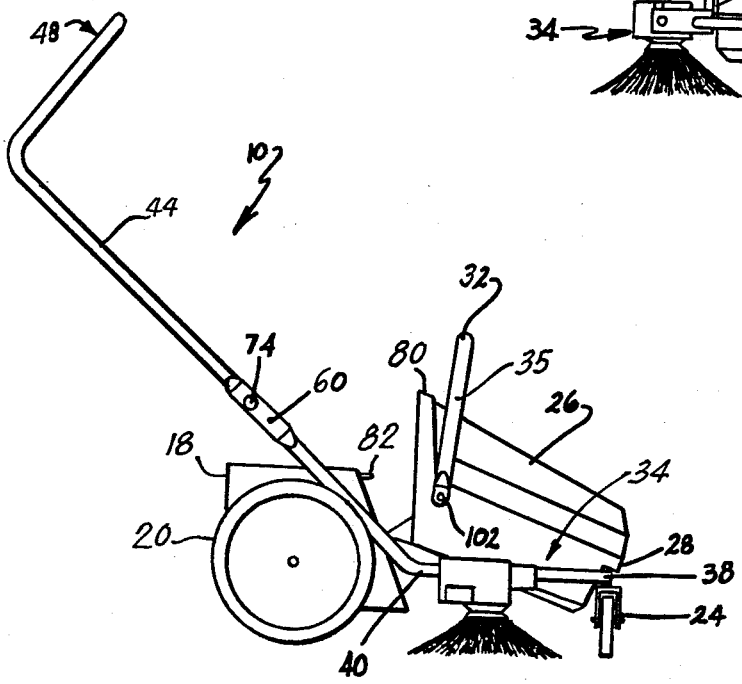
FIG. 3 is a side elevational view showing the hopper partially removed.

The preferred embodiment of the unique push sweeper in accordance with the present invention is illustrated in FIGS. 1, 2 and 3 and generally designated 10. The sweeper 10 includes a tubular member 12 having a generally rectangular shape and being bent to form a forward sweeper supporting frame portion 14 and a rearward, upwardly directed handle portion 16. A brush housing 18 is secured at each end to a side of tubular member 12, generally at the juncture of the forward frame portion 14 and handle portion 16. A pair of ground engaging wheels 20, 22 support the brush housing 18. A forwardly located caster wheel 24 is mounted on and supports the forward end of the frame portion 14 of tubular member 12.

Figure 6:
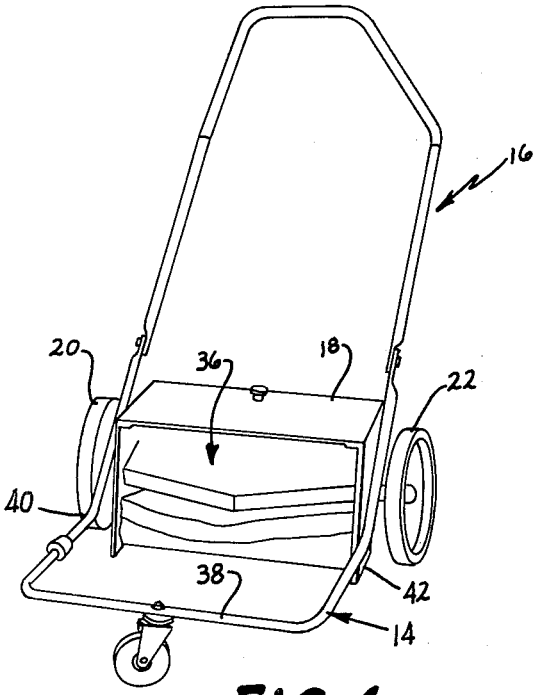
FIG. 6 is a front, perspective view showing the push sweeper with the dust bin totally removed.

A molded plastic dust bin 26 includes a forwardly located shoulder portion 28 adapted to rest on the frame portion 14 and a recess 30 formed in its front wall for housing the caster wheel 24 and for creating a hand hold at the front of the machine. A dust bin handle 32 is pivotally connected to the rear end of the dust bin 26 to facilitate removal of the dust bin from tubular frame portion 14. A side brush arrangement 34 is pivotally mounted along one side of the frame portion 14, the pivoting being facilitated by the fact that tubular member 12 is generally circular in cross section, at least in the vicinity of side brush 34. As seen in FIG. 6, a cylindrical brush 36 schematically shown is rotatably mounted within the brush housing 18. The specific details of the mounting arrangement will be more fully described below in connection with FIG. 11.

As best seen in FIGS. 3 and 6, the forward frame portion 14 has a generally U-shaped configuration including a forwardly located base portion 38 and leg portions 40, 42. The leg portions 42 extend horizontally for a portion of their length and then angle upwardly along the sides of the bush housing. These upwardly and rearwardly extending leg portions then join and merge or blend into the upwardly and rearwardly extending handle portion 16. In the preferred embodiment, the exact point at which the frame portion 14 stops and handle portion 16 starts is not capable of precise definition, although precise definition is not required for purposes of describing the invention.

The handle 16 is of a unique, ergonomically designed shape resulting in reduced operator fatigue during use of the sweeper. The handle portion 16 includes spaced, parallel leg portions or side members 44, 46 which are pivotally articulated at 60 to allow handle 16 to be folded. Integral with the upper ends of the side members 44, 46 is an operator gripping and control portion 48. As best seen in FIG. 3, the gripping portion 48 is positioned in a plane generally perpendicular to the plane of the side portions 44, 46.

The operator gripping portion 48 is configured in a generally truncated V shape including outwardly extending legs 50, 52 and a transversely extending base 54. The legs 50, 52 are angled with respect to the sides 44, 46 and with respect to the truncated base 54 so as to mate with the natural inturned position of an operator's hands when he reaches out in front of his body. Further, the truncated V shape defines an operator receiving area in that the operator may position himself within the confines of the handle and push the sweeper merely by leaning against the truncated base 54. Also, by being bodily within the truncated V, it is much easier for the operator to turn the machine since he simply has to push generally laterally to the left or right, directly away from the mass of his body. The handle portion 16 is ergonomically designed so as to conform to the anatomical nature of an operator. The proper mating between the operator and the sweeper results in reduced fatigue due to muscle strain and increased ease of control.

The use of the tubular frame 12 including the lower frame portion 14 and the handle portion 16 greatly simplifies the overall structural arrangement of the sweeper, reduces the cost of manufacture, simplifies the assembly of the sweeper and results in increased durability.

Figure 14:
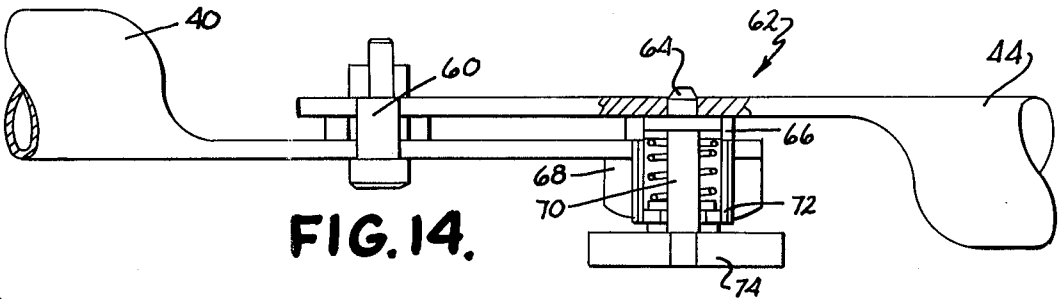
FIG. 14 is an enlarged fragmentary partially cross sectioned view showing the connection between the handle and the tubular frame of the push sweeper.

As best seen in FIG. 14, the legs 44, 46 of the handle 16 are pivotally connected to the leg portions 40, 42 of the main frame portion 14 by suitable pivot pins 60. The ends of the members 40, 44 are flattened to facilitate the articulated connection. A spring loaded plunger arrangement 62 is carried by the tubular portions extending up from frame legs 40, 42. The spring loaded plunger 62 cooperates with an aperture 64 formed in the end of the handle portions 44, 46 to provide an arrangement for releasably interconnecting the frame members. The plunger arrangement 62 includes a cylindrical spring retainer 66 surrounded by a nut 68 and secured to the frame member 40. A plunger 70 is disposed within the spring retainer and is biased toward the aperture 64 by a spring 72. A hand knob 74 is secured to the plunger 70 to permit movement of the plunger out of the aperture 64 against the bias of the spring 72.

Figure 4:
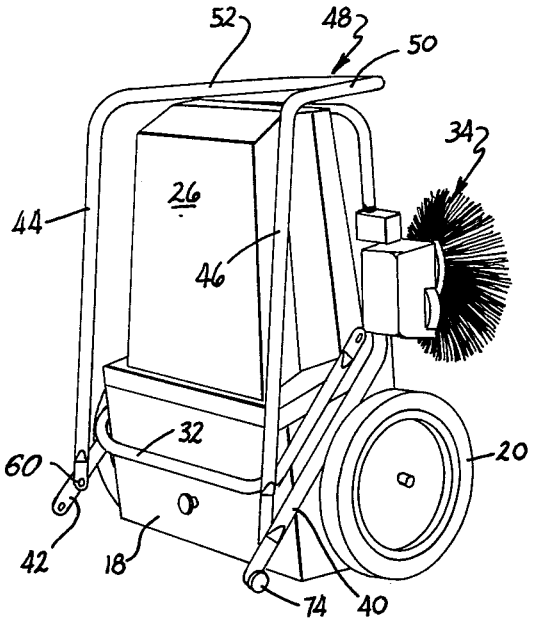
FIG. 4 is a perspective view showing the push sweeper in one of its stored upright positions.

The shape of the frame 12 and its articulated nature readily permit storage of the sweeper by standing it on either end. As shown in FIG. 4, when the handle portion 16 is folded forwardly, the sweeper may be positioned so that it is resting on ground engaging wheels 20, 22 and the ends of the portions 40, 42 of the support frame portion 14. By forming the dust bin 26 with a recess 30 adapted to house the front caster wheel 24, a forward gripping handle is also provided on tubular member 12. As a result, the sweeper may be easily placed in this upright position by folding the handle downwardly and gripping the front portion 38 of the frame at the recess 30. In the alternative, the support frame portion 14 may be dimensioned so that the sweeper is supported by the rear wall of the brush housing 18.

Figure 5:
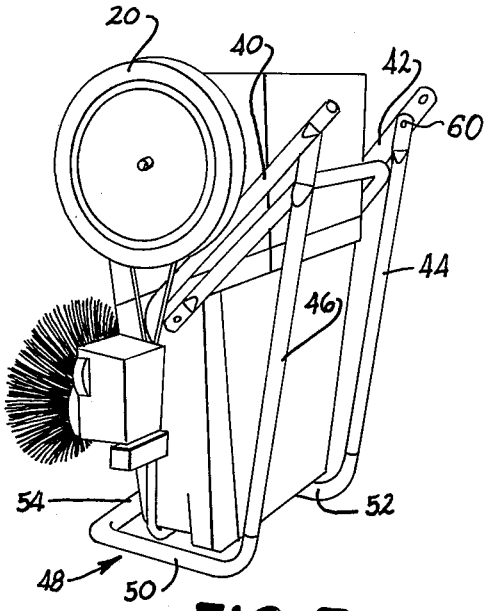
FIG. 5 is a perspective view showing the push sweeper in another of its stored upright positions.

As shown in FIG. 5, when the handle portion 16 is released and folded forwardly so that the truncated V-shaped operator gripping portion 48 is disposed in front of the bin 26, the sweeper may be stored in an upright position resting on the operator gripping portion. The capability of storing the sweeper by standing it on its forward end permits storage without prior dumping of the contents in the dust bin 26. If the sweeper is stood on its rear end prior to dumping of the dust bin, all the collected debris will fall into the brush housing and consequently onto the floor of the storage area. By standing the sweeper vertically on the forwardly pivoted handle, the dirt, dust and debris is retained within the dust bin.

Figure 10:
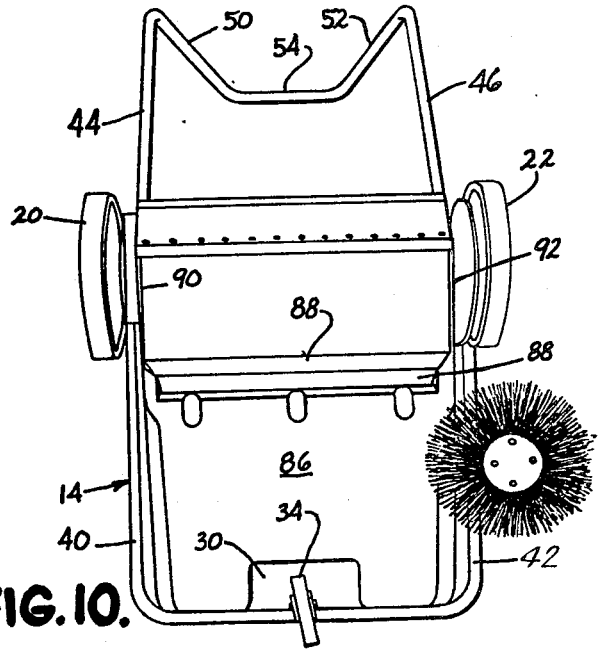
FIG. 10 is a bottom view of the push sweeper.
Figure 12:
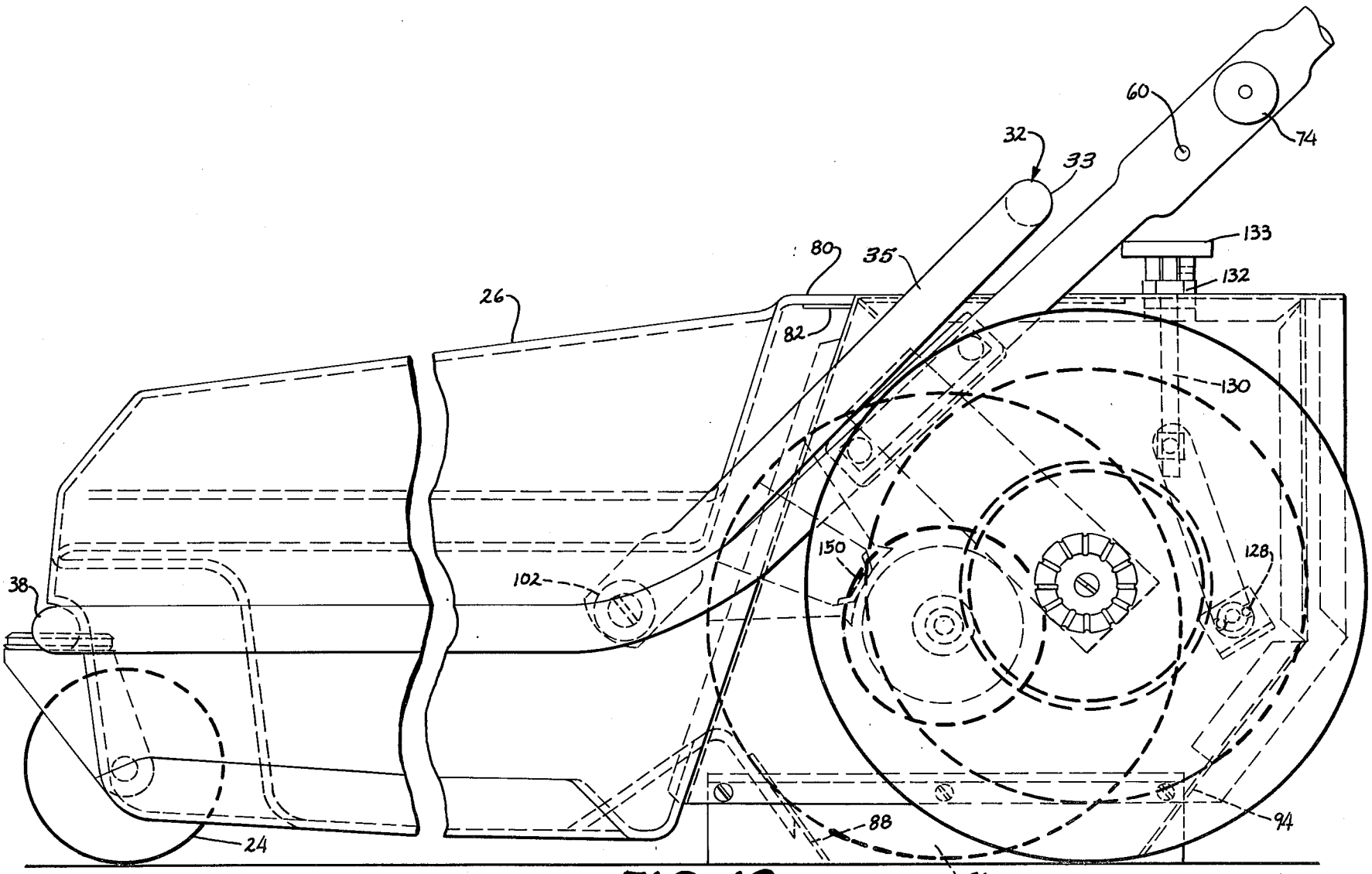
FIG. 12 is an enlarged, fragmentary side elevational view of the push sweeper.

The dust bin 26, besides including the forward shoulder 28 and the caster wheel housing 30, also includes an outwardly directed, peripheral skirt 80. As best seen in FIG. 12, the peripheral skirt 80 is adapted to mate with an upper flange or skirt portion 82 formed integral with the top wall of the brush housing 18. In this manner, the bin 26 is supported at its forward end by the frame 14 and at its rearward end by the housing. Further, the bin is formed with an angled skirt 84 extending along the inlet of the hopper and integral with the bottom wall 86 of the hopper. A flat 88 may be connected to the skirt 84 to form a forward dust seal arrangement (FIG. 10). Also, side skirts 90, 92 and a rear skirt 94 are preferably secured to the side walls and the rear wall, respectively of the brush housing 18. The skirt or flap members serve as dust seals and help to retain the dust and debris within the confines of the sweeper during its operation.

Figure 7:
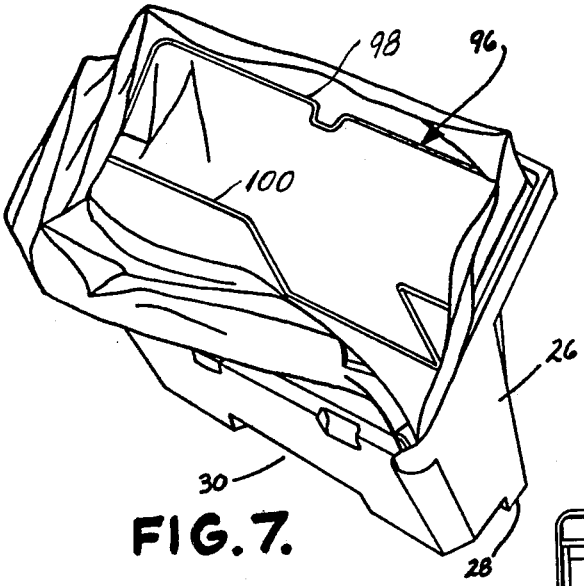
FIG. 7 is a perspective view showing the manner in which a plastic bag is retained within the dust bin by means of a bag frame.
Figure 8:
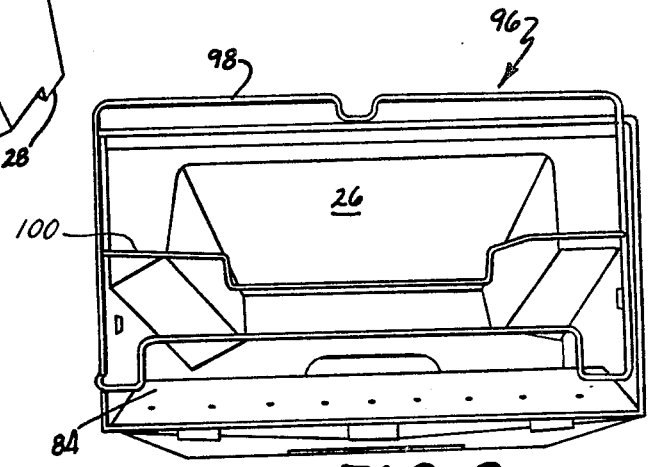
FIG. 8 is an end elevational view showing the shape of the bag frame in relation to the dust bin.
Figure 9:
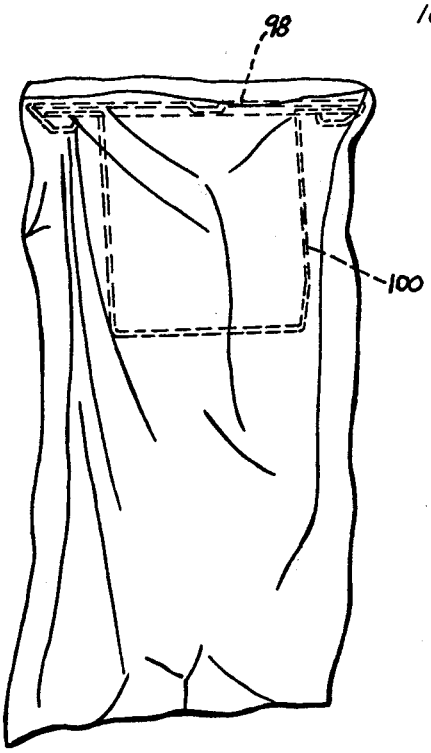
FIG. 9 is a view showing the manner in which the bag frame is inserted within the bag prior to placement within the dust bin.

As best seen in FIGS. 7, 8 and 9, an optional wire bag frame 96 is provided for holding a plastic bag in the dust bin 26. The bag frame 96 includes a generally rectangular wire portion 98 shaped so as to conform to the inlet opening of the bin. An outwardly extending wire frame portion 100 is secured to the rectangular portion and supports the plastic bag within the bin. This support keeps the bag from collapsing and preventing dust and debris from entering the bin. As shown in FIG. 9, it is preferred that the bag have a length substantially greater than the length of the wire frame portion 100. In this manner, when the bag and frame are placed within the bin the frame will hold the mouth of the bag open and in fact wedge it against the sides of the dust bin 26. When the bag is removed from the dust bin, the debris will collect in the lower portion of the bag which greatly reduces the chance of this material leaving the bag prior to tying the mouth of the bag for disposal. Also, this facilitates shaking dust and debris off frame 96 and down into the bottom of the bag before frame 96 is removed from the bag.

As previously mentioned, the bin 26 is provided with a pivotable handle 32. The handle 32 is secured to the bin adjacent the inlet or mouth portion of the bin at pivot points 102. The handle includes a transversely extending grip 33 and depending legs 35. As best seen in FIG. 3, upon upward, pulling movement of the handle 32, the bin is lifted free of the tubular frame portion 14. As the bin is lifted, it will pivot so as to extend vertically. This feature greatly reduces the chance of debris falling from the bin when it is removed from the frame of the sweeper and substantially alleviates the awkward handling problems heretofore experienced. It enhances the function of the frame portion 14 of the tubular member 12 by making it unnecessary to tack special bin pivoting devices onto the brush housing.

Figure 11:
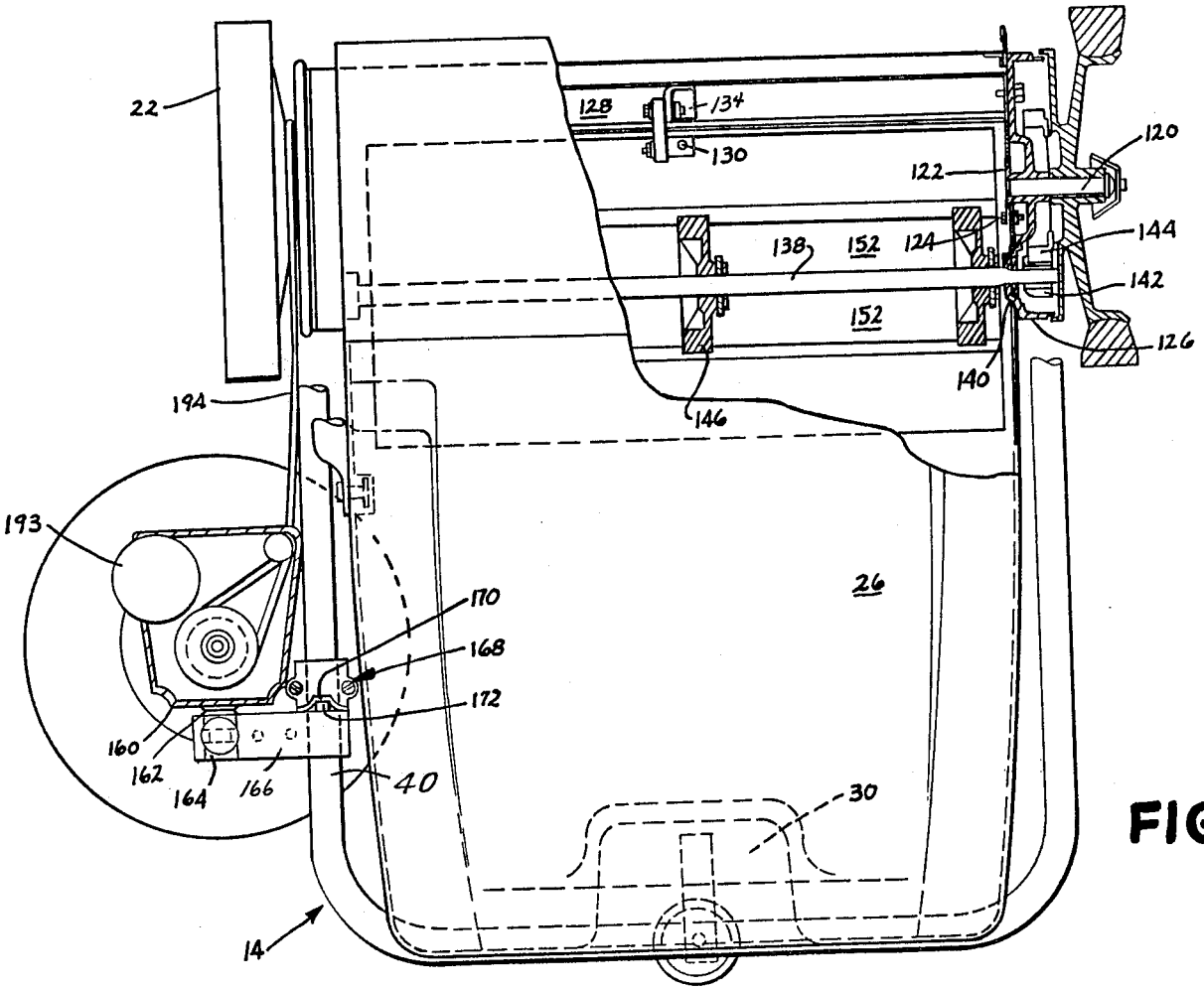
FIG. 11 is an enlarged fragmentary, partially sectioned plan view of the push sweeper.

A brush height adjustment mechanism and a brush drive arrangement are best seen in FIGS. 11 and 12. Each wheel 20, 22 is rotatably mounted on a rear axle shaft assembly 120. The shaft assembly is weldably or otherwise suitably secured to a pivot plate 122. The pivot plate 122 is pivotally secured to the side wall of the brush housing 18 by a suitable fastener 124. Non-rotatably secured to the shaft 120 is a brush adjusting hub 126. Each brush adjusting hub 126 is interconnected to the other by a bar assembly 128. Centrally positioned between the ends of the brush housing 18 is an externally threaded brush adjustment shaft 130. The adjustment shaft 130 threadably engages an internally threaded nut 132 secured to the upper wall or top surface of the brush housing. The shaft 130 extends downwardly and is secured to a block 134. An adjusting link 136 is pivotally connected at one end to the block 134 and at the other end to the adjusting bar assembly 128. Positioned forwardly of the rear axle shaft assembly 120 and extending transversely between the brush adjusting hubs 126 is a sweeper brush shaft 138. The sweeper brush shaft 138 is rotatably supported by the hub 126 through suitable bearings 140. Non-rotatably secured to each end of the shaft 138 is a driven pinion 142. The driven pinion mates with a drive gear 144 which in turn is non-rotatably secured to the wheel 20. Suitable one-way clutches may be employed to mount the driven pinion gears 142 so that the brush 138 will be rotated in a constant direction when the sweeper is pushed in either a forward or reverse direction. Non-rotatably secured to the brush shaft 138 are a plurality of brush drivers 146. As best seen in FIG. 12, each brush driver 146 is formed with dovetail type recesses 148. A clip-like retainer 150 is employed to retain individual brush segments 152 on the brush drivers.

As is apparent from the above description when taken in conjunction with the drawings, upon forward movement of the push sweeper, the ground engaging wheels 20, 22 rotate the brush through the gear arrangement. By rotating the brush adjustment knob 133, the shaft 130 will move upwardly or downwardly. As a result, the bar assembly 128 will be raised or lowered resulting in pivoting movement of the rear axle assemblies 120 about their pivot points 124. This raising or lowering of the wheel assemblies will vary the effective height of the brush relative to the ground.

Figure 13:
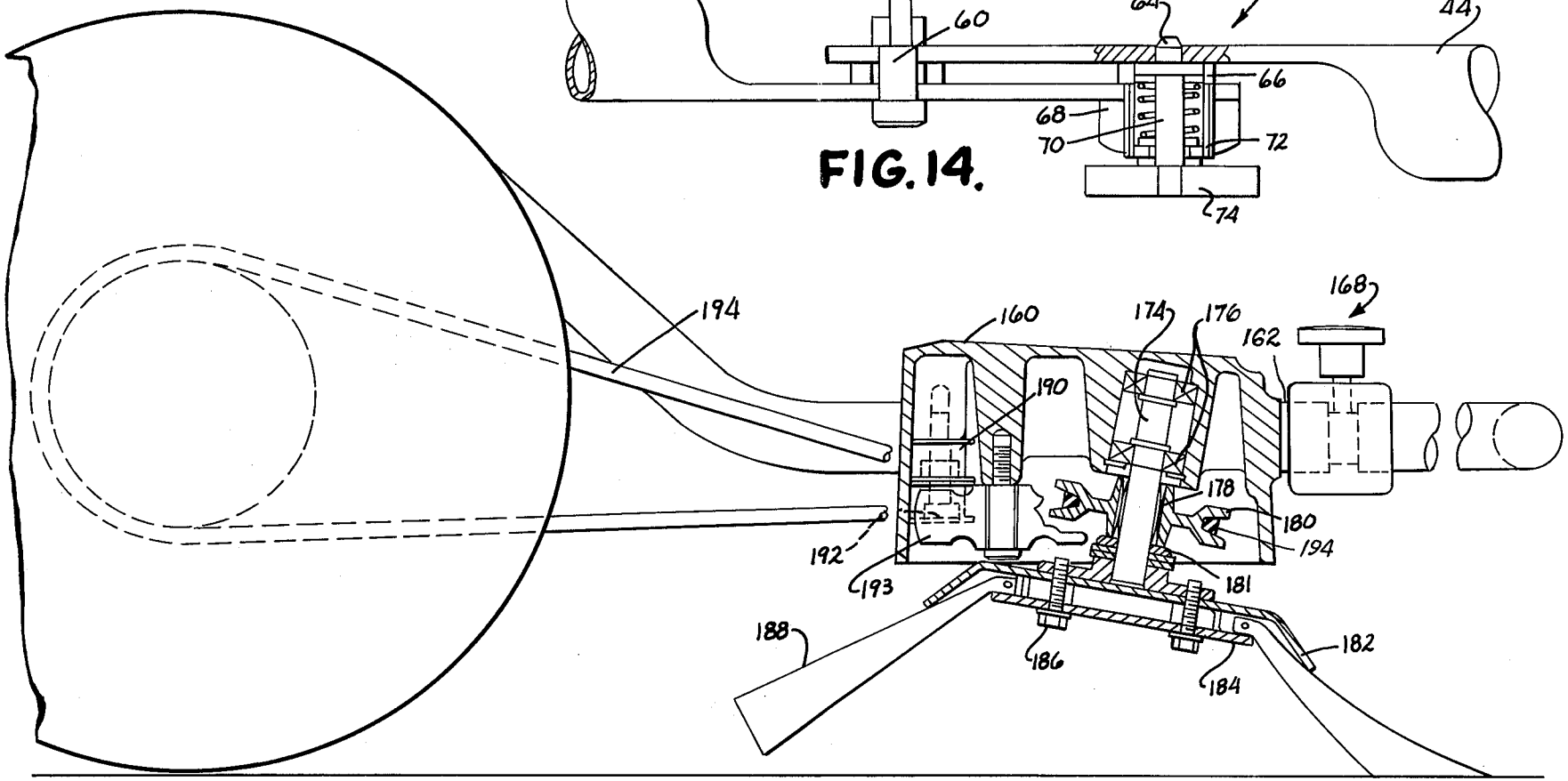
FIG. 13 is an enlarged fragmentary partial cross-sectional side elevational view of the sweeper showing the details of the side brush construction.

With reference to FIGS. 11 and 13, the side brush assembly 34 is shown as including a side brush housing 160 having a mounting shaft 162. The mounting shaft 162 is received within a bore 164 formed in one end of a side brush mounting arm assembly 166. A suitable brush adjustment knob and set screw arrangement 168 is carried by the arm assembly 166 to lock the shaft 162 within the bore 164. The angular position of the housing 160 with respect to the side brush arm assembly may be readily adjusted by rotating the shaft 162.

A clamp assembly 168 is non-rotatably positioned on the tubular frame 14 along leg 40. The clamp assembly 168 is provided with a suitable detent or slot 170. The detent 170 is adapted to receive a pin 172 formed integral with one end of the side brush arm assembly 166. The side brush arm assembly 166 includes a bore through which the leg 40 extends. As a result, the side brush arm assembly may be folded upwardly into a storage position. Upon downward pivotal or folding movement of the side brush arm, the pin 172 is received by the slot 170, thereby properly positioning the side brush. The drive belt 194 provides the biasing tension which urges arm 166 against clamp 168, and thereby urges detent pin 172 into slot 170.

As best seen in FIG. 13, the side brush housing 160 supports a side brush shaft 174 through suitable bearings 176. Secured to the shaft 174 through a suitable one-way clutch 178 is a side brush drive pulley 180. Non-rotatably secured to the lower end of the side brush shaft 174 is the side brush hub 181. A side brush holder plate 182 and a side brush retaining plate 184 are secured to the side brush hub by suitable fasteners 186. A side brush 188 is sandwiched between the retainer plate 184 and the brush holder 182. Rotatably mounted within the housing 160 are coaxially aligned upper and lower idler pulleys 190, 192 respectively. An endless drive belt 194 is reaved around the wheel assembly 22, upper idler pulley 190, side brush drive pulley 180 and the lower idler pulley 192. As is readily apparent, upon rotation of the ground engaging wheel 22, rotational movement is imparted to the side brush 188 through the endless belt 194. A wall bumper 193 of suitable resilient material may also be mounted on the side brush housing.

Figure 15:
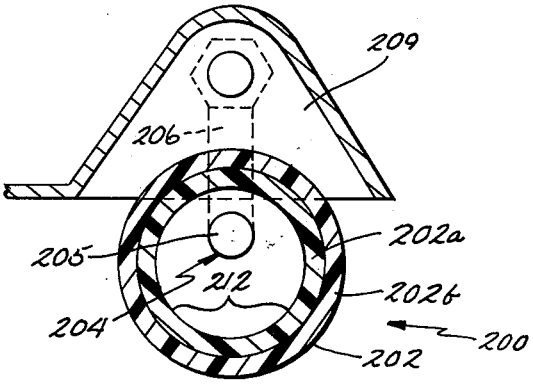
FIG. 15 is an enlarged fragmentary, partially sectioned side elevational view illustrating an improved roller type dust seal.

The previously described dust seal arrangement, including the flexible, depending skirt or flaps 88, 90 and 94, may be improved on by incorporating as an alternative to flap 88 a forwardly positioned, roller type dust seal generally designated 200 and illustrated in FIG. 15. The dust seal includes a plurality of roller segments 202 supported on a transversely extending axle 204. The axle 204 is generally U-shaped, having an elongated base 205 and legs 206. The legs 206 are secured to end walls 209 formed at the ends of the lip portion 210 of the dust bin 26. Each roller segment 202 includes an enlarged center or bore 212 having a diameter substantially greater than that of the axle 204. As a result, the roller 202 is permitted to move in a vertical direction relative to the axle 204. It is preferred that the roller segments 202 be approximately one and one-quarter inches in length and be formed from a rubber or vinyl-like material. Preferably, the inner section **202*a* is hard vinyl and the outer portion 202*b* is soft vinyl. The roller seal 202** will deflect upwardly only when necessary to permit passage of the debris encountered. After the segments have passed over the object, they will drop back down into contact with the surface being swept. As a result, an effective seal is provided which retains the dust and other particles within the confines of the sweeper so that the brush will sweep the material forwardly into the dust bin. This feature is more fully disclosed in copending application Ser. No. 655,059 entitled "Sweeper Dust Seal" filed on Feb. 4, 1976 by the present inventor and owned by the assignee of this application.

It can be seen, therefore, that the push sweeper in accordance with the present invention incorporates a unique tubular frame having an ergonomically designed handle and which permits ready storage by standing the sweeper on either end. The driving arrangement for the sweeper brush, the brush height adjustment arrangement, the fold-down side brush assembly and the structural arrangement of the dust bin all result in a push sweeper having increased efficiency and ease of operation. The frame is easily formed by bending a tubular steel or aluminum product and the bin is an easily molded plastic item. The brush housing may be constructed from sheet metal or molded plastic. The tubular frame is the focal point of the design and presents an uncluttered, aesthetically pleasing appearance. Various modifications will undoubtedly occur to those of ordinary skill in the art. It is expressly intended, therefore, that the above description be considered as that of the preferred embodiment.

The embodiments of the invention in which an exclusive property or privilege is claimed are defined as follows:

1. A sweeper comprising:

a brush housing;

a generally continuous, tubular member constituting a combined tubular frame and handle, said tubular member including a generally U-shaped integral tubular forward portion having a forwardly located base and rearwardly extending leg portions, said leg portions extending generally horizontally for a portion of their lengths and then being angled upwardly and rearwardly and being joined to said brush housing at said upward and rearward angled portion; said integral tubular forward portion terminating at the ends of said upwardly and rearwardly extending leg portions, at a point generally adjacent said brush housing and joining and blending into an upwardly and rearwardly extending tubular handle portion, said handle being articulated at said terminating point of said integral tubular forward portion, generally adjacent said brush housing, said handle portion having a lower portion and an upper operator gripping and control portion and further including releasable detent means at said point of articulation whereby said handle can be maintained in a rearwardly extending operable position, but can be released and folded over the top of said brush housing and said dust bin into a stored position, whereby said sweeper can be tipped up and stored on end;

a brush housing secured on each end to said tubular member generally at said juncture of said frame and handle portion of said tubular member;

a pair of ground engaging wheels;

means for rotatably mounting said wheels to said brush housing;

a brush rotatably supported within said brush housing;

forward support means secured to said frame portion of said tubular member for supporting the forward end of said frame portion; and a dust bin removably supported by resting only on said frame portion of said tubular member and on said brush housing and having an opening at one end and being positioned with said opening adjacent said brush and said brush housing so as to receive debris swept up by said brush.

2. The sweeper of claim 1 in which said lower portion of said handle portion generally defines a plane, said upper gripping and control portion extending sharply upwardly out of the plane of said lower portion and defining a V shape such that each leg of the V provides a convenient hand gripping surface generally at either side of the operator's body.

3. The sweeper of claim 2 in which said upper gripping and control portion of said handle is of a truncated V shape having two handle legs joined by a handle base, said base providing a surface against which an operator can lean.

4. The sweeper of claim 3 in which said upper gripping and control portion of said handle extends perpendicularly to the plane of said lower portion of said handle.

5. A sweeper comprising:

a generally continuous, tubular member constituting a combined tubular frame and handle, said tubular member including a generally U-shaped forward portion having a forwardly located base and rearwardly extending leg portions, said leg portions extending generally horizontally for a portion of their lengths and then being angled upwardly and rearwardly and joining and blending into an upwardly and rearwardly extending handle portion, said handle portion having a lower portion and an upper operator gripping and control portion;

a brush housing secured on each end to said tubular member generally at said junction of said frame and handle portion of said tubular member;

a pair of ground engaging wheels;

means for rotatably mounting said wheels to said brush housing;

a brush rotatably supported within said brush housing;

forward support means secured to said frame portion of said tubular member for supporting the forward end of said frame portion; and a dust bin supported by said frame portion of said tubular member and by said brush housing and having an opening at one end and being positioned with said opening adjacent said brush and said brush housing so as to receive debris swept up by said brush, said lower portion of said handle portion generally defining a plane, said upper gripping and control portion extending sharply upwardly out of the plane of said lower portion and defining a V shape such that each leg of the V provides a convenient hand gripping surface generally at either side of the operator's body, said upper gripping and control portion of said handle being of a truncated V shape having two handle legs joined by a handle base, said base providing a surface against which an operator can lean, said upper gripping and control portion of said handle extending perpendicularly to the plane of said lower portion of said handle, and said handle being articulated at a point generally adjacent said brush housing; and further including releasable detent means at said point of articulation whereby said handle can be maintained in a rearwardly extending operable position, but can be released and folded over the top of said brush housing and said dust bin into a stored position; said handle having sufficient length from said point of articulation to said upper portion so that when said handle is folded into its stored position said upper portion of said handle extends down in front of said dust bin such that said sweeper can be tipped up and stored resting on said upper portion of said handle with said opening of said dust bin pointed up.

6. A sweeper comprising:

a generally continuous, tubular member constituting a combined tubular frame and handle, said tubular member including a generally U-shaped forward portion having a forwardly located base and rearwardly extending leg portions, said leg portions extending generally horizontally for a portion of their lengths and then being angled upwardly and rearwardly and joining and blending into an upwardly and rearwardly extending handle portion, said handle portion having a lower portion and an upper operator gripping and control portion;

a brush housing secured on each end to said tubular member generally at said juncture of said frame and handle portion of said tubular member;

a pair of ground engaging wheels;

means for rotatably mounting said wheels to said brush housing;

a brush rotatably supported within said brush housing;

forward support means secured to said frame portion of said tubular member for supporting the forward end of said frame portion; and a dust bin supported by said frame portion of said tubular member and by said brush housing and having an opening at one end and being positioned with said opening adjacent said brush and said brush housing so as to receive debris swept up by said brush, said lower portion of said handle portion generally defining a plane, said upper gripping and control portion extending sharply upwardly out of the plane of said lower portion and defining a V shape such that each of the V provides a convenient hand gripping surface generally at either side of the operator's body, and said handle being articulated at a point generally adjacent said brush housing; and further including releasable detent means at said point of articulation whereby said handle can be maintained in a rearwardly extending operable position, but can be released and folded over the top of said brush housing and said dust bin into a stored position; said handle having sufficient length from said point of articulation to said upper portion so that when said handle is folded into its stored position said upper portion of said handle extends down in front of said dust bin such that said sweeper can be tipped up and stored resting on said upper portion of said handle with said opening of said dust bin pointed up.

7. A sweeper comprising:

a generally continuous, tubular member comprising a combined tubular frame and handle, said tubular member including a generally U-shaped forward portion having a forwardly located base and rearwardly extending leg portions, said leg portions extending generally horizontally for a portion of their lengths and then being angled upwardly and rearwardly and joining and blending into an upwardly and rearwardly extending handle portion, said handle portion having a lower portion and an upper operator gripping and control portion;

a brush housing secured on each end to said tubular member generally at said juncture of said frame and handle portion of said tubular member;

a pair of ground engaging wheels;

means for rotatably mounting said wheels to said brush housing;

a brush rotatably supported within said brush housing;

forward support means secured to said frame portion of said tubular member for supporting the forward end of said frame portion; and a dust bin supported by said frame portion of said tubular member and by said brush housing and having an opening at one end and being positioned with said opening adjacent said brush and said brush housing so as to receive debris swept up by said brush, said lower portion of said handle portion generally defining a plane, said upper gripping and control portion extending sharply upwardly out of the plane of said lower portion and defining a V shape such that each leg of the V provides a convenient hand gripping surface generally at either side of the operator's body, and said sweeper further including handle articulating means operatively associated with said handle portion of said frame and said leg portions of said frame for locking the handle in an operating position and for permitting selective forward pivotal movement of said handle portion so that said operator gripping and control portion is positionable in front of said dust bin whereby upon pivotal movement of said handle said sweeper may be stood on either end for storage purposes.

8. A sweeper comprising:

a generally continuous, tubular member constituting a combined tubular frame and handle, said tubular member including a generally U-shaped forward portion having a forwardly located base and rearwardly extending leg portions, said leg portions extending generally horizontally for a portion of their lengths and then being angled upwardly and rearwardly and joining and blending into an upwardly and rearwardly extending handle portion, said handle portion having a lower portion and an upper operator gripping and control portion;

a brush housing secured on each end to said tubular member generally at said juncture of said frame and handle portion of said tubular member;

a pair of ground engaging wheels;

means for rotatably mounting said wheels to said brush housing;

a brush rotatably supported within said brush housing;

forward support means secured to said frame portion of said tubular member for supporting the forward end of said frame portion; and a dust bin supported by said frame portion of said tubular member and by said brush housing and having an opening at one end and being positioned with said opening adjacent said brush and said brush housing so as to receive debris swept up by said brush, said handle being articulated at a point generally adjacent said brush housing; and further including releasable detent means at said point of articulation whereby said handle can be maintained in a rearwardly extending operable position, but can be released and folded over the top of said brush housing and said dust bin into a stored position, whereby said sweeper can be tipped up and stored on end, and said ground engaging wheels and said handle portion being dimensioned so that when said handle portion is folded into the stored position said sweeper can be tipped up and stored resting on said wheels and the back wall of said brush housing.

9. A sweeper as defined by claim 1 wherein said dust bin includes a front wall projecting forwardly and defining a transversely extending shoulder adapted to rest on said base portion of said frame; said front wall including a recess interrupting said shoulder for housing said forward support means, said recess leaving a portion of said base portion of said frame accessible to be gripped by hand.

10. A sweeper comprising:

a generally continuous, tubular member constituting a combined tubular frame and handle, said tubular member including a generally U-shaped forward portion having a forwardly located base and rearwardly extending leg portions, said leg portions extending generally horizontally for a portion of their lengths and then being angled upwardly and rearwardly and joining and blending into an upwardly and rearwardly extending handle portion, said handle portion having a lower portion and an upper operator gripping and control portion;

a brush housing secured on each end to said tubular member generally at said juncture of said frame and handle portion of said tubular member;

a pair of ground engaging wheels;

means for rotatably mounting said wheels to said brush housing;

a brush rotatably supported within said brush housing;

forward support means secured to said frame portion of said tubular member for supporting the forward end of said frame portion; and a dust bin supported by said frame portion of said tubular member and by said brush housing and having an opening at one end and being positioned with said opening adjacent said brush and said brush housing so as to receive debris swept up by said brush, said sweeper further including:

a bag having a length substantially greater than the length of said dust bin and adapted to be positioned within said bin for containing debris; and a bag frame having a generally rectangular wire portion dimensioned so as to fit within the inlet of said bin, and also having an outwardly extending bag supporting portion extending within said bag.

11. A sweeper comprising:

a generally continuous, tubular member constituting a combined tubular frame and handle, said tubular member including a generally U-shaped forward portion having a forwardly located base and rearwardly extending leg portions, said leg portions extending generally horizontally for a portion of their lengths and then being angled upwardly and rearwardly and joining and blending into an upwardly and rearwardly extending handle portion, said handle portion having a lower portion and an upper operator gripping and control portion;

a brush housing secured on each end to said tubular member generally at said juncture of said frame and handle portion of said tubular member;

a pair of ground engaging wheels;

means for rotatably mounting said wheels to said brush housing;

a brush rotatably supported within said brush housing;

forward support means secured to said frame portion of said tubular member for supporting the forward end of said frame portion; and a dust bin supported by said frame portion of said tubular member and by said brush housing and having an opening at one end and being positioned with said opening adjacent said brush and said brush housing so as to receive debris swept up by said brush, a forward portion of at least one of said legs of said frame portion of said tubular member being generally circular in cross section, and said sweeper further including:

a side brush for said sweeper including a pivot arm extending therefrom, said pivot arm including an end encompassing said circular portion of said frame leg and being rotatable with respect thereto, whereby said side brush can readily be pivoted up into a stored condition or down into an operative condition.

12. A sweeper as defined by claim 11 wherein said dust bin includes a bin carrying handle having a transversely extending grip and depending legs pivotally secured to the side walls of said bin adjacent the inlet of said bin whereby upon upward pulling movement of said handle, said bin may be removed from said frame and pivot to a vertical position thereby preventing egress of debris from said bin.

13. The sweeper of claim 11 wherein said side brush further includes a side brush housing having a housing shaft extending from a forward portion thereof, said pivot arm having a transverse bore through the end opposite said frame leg and said housing shaft being received within said bore, said pivot arm further including an outwardly extending pin adjacent said leg; and a clamp secured to said leg adjacent said pivot arm, said clamp having a detent slot for receiving said pin when said side brush is pivoted down into an operating position.

14. The sweeper of claim 13, said side brush further including a side brush shaft rotatably supported within said side brush housing; a side brush driven pulley nonrotatably secured to said side brush shaft; and an endless belt extending from the ground engaging wheel positioned on the same side as said side brush housing around said driven pulley whereby the endless belt provides the biasing tension urging the pivot arm against said clamp and therefore urging the detent pin within said detent clamp.

15. The sweeper of claim 14 wherein said side brush further includes a side brush adjustment means carried by said pivot arm adjacent said housing shaft for permitting angular adjustment of said side brush housing relative to said pivot arm and for securely fixing said housing shaft within said pivot arm transverse bore.

16. A surface treating apparatus, comprising:

a body;

a pair of ground engaging wheels rotatably supported by said body; and an upwardly and rearwardly extending handle, said handle being a continuous tubular member and including a lower portion and an upper operator gripping and control portion extending in a plane perpendicular to the plane of said lower portion, said lower portion having spaced, parallel side members secured at their lower ends to said body, and said upper gripping and control portion extending sharply upwardly out of the plane of said lower portion to thereby define an operator receiving area whereby the operator may position himself within the confines of the handle, said upper gripping and control portion having a general V shape such that the legs of the V provide a convenient hand gripping surface at either side of the operator's body, and said parallel side members being pivotally secured to said body at their lower ends and further including releasable detent means at said pivot points for securing said handle in a rearwardly extending operable position and for selectively permitting forward pivotal movement of said handle to a storage position, said handle side members having sufficient length so that when said handle is pivoted forward said upper gripping and control portion extends down in front of said body so that said apparatus can be tipped up and stored resting completely on said upper portion of said handle.

17. The surface treating apparatus as defined by claim 16 wherein said body includes a squared off back portion and the parallel side members of said handle are pivotally secured to said body adjacent said squared off back portion, whereby said apparatus may be tipped for storage on either end resting on said gripping and control portion in one storage position or resting on said ground engaging wheels and said squared off back portion of said body in a second storage position.

* * * * *